US006082917A

United States Patent [19]

Noguchi et al.

[11] Patent Number: 6,082,917

[45] Date of Patent: Jul. 4, 2000

[54] DISPENSER FOR SELECTIVELY EXTENDING AND RETRACTING A SUBSTANTIALLY STICK-SHAPED OBJECT, AND THREAD MEANS FOR INCORPORATION IN THE DISPENSER

[75] Inventors: Yoshio Noguchi; Sachio Arai, both of Kawagoe, Japan

[73] Assignee: Kotobuki & Co., Ltd., Kyoto, Japan

[21] Appl. No.: 09/208,010

[22] Filed: Dec. 9, 1998

[30] Foreign Application Priority Data

Dec. 9, 1997 [JP] Japan ..... 9-354026

[51] Int. Cl.[7] ..... A45D 40/06

[52] U.S. Cl. ..... 401/75; 401/68; 401/86

[58] Field of Search ..... 401/75, 76, 68, 401/86

[56] References Cited

U.S. PATENT DOCUMENTS

| | | | |
|---|---|---|---|
| 1,541,085 | 6/1925 | Wehn | 401/68 X |
| 2,563,943 | 8/1951 | Kruck | 401/75 |
| 3,589,821 | 6/1971 | Barney et al. | 401/75 |
| 4,166,474 | 9/1979 | McArdle et al. | 401/75 X |
| 4,702,399 | 10/1987 | Davis | 401/75 X |
| 4,954,000 | 9/1990 | Gueret | 401/75 X |
| 5,131,773 | 7/1992 | Gueret | 401/75 X |
| 5,294,205 | 3/1994 | Moeck et al. | 401/68 X |
| 5,549,404 | 8/1996 | Kageyama et al. | 401/75 |
| 5,727,891 | 3/1998 | Lang | 401/75 X |
| 5,879,093 | 3/1999 | Ohba et al. | 401/68 |
| 5,888,004 | 3/1999 | Bouix | 401/68 X |

*Primary Examiner*—Henry J. Recla
*Assistant Examiner*—Kathleen J. Prunner
*Attorney, Agent, or Firm*—McGinn & Gibb, P.C.

[57] ABSTRACT

A dispenser for selectively extending and retracting a substantially stick-shaped object, including a substantially cylindrical body, a sleeve member received in the cylindrical body and having a closed end, the cylindrical body and the sleeve member being rotatable relative to each other, an axially movable member inserted in the sleeve member, the movable member including a substantially rod-like body having first and second ends, and a receiver member mounted on the first end of the rod-like body, the rod-like body having a first threaded portion formed around a periphery thereof, the rod-like body extending through the closed end of the sleeve member to project into the cylindrical body, and a thread member fixed in the cylindrical body, the thread member having a second threaded portion, the second threaded portion of the thread member being engaged with the first threaded portion of the movable member, so that when one of the cylindrical body and the sleeve member is rotated relative to the other of the cylindrical body and the sleeve member, the movable member is axially moved, to thereby selectively extend and retract the stick-shaped object having been supported by the receiver member, according to a rotational direction of the cylindrical body or the sleeve member.

40 Claims, 4 Drawing Sheets

DISPENSER FOR SELECTIVELY EXTENDING AND RETRACTING A SUBSTANTIALLY STICK-SHAPED OBJECT, AND THREAD MEANS FOR INCORPORATION IN THE DISPENSER

BACKGROUND OF THE INVENTION

1. Field of the Invention

This invention relates to a dispenser for selectively extending and retracting a substantially stick-shaped object, such as a solid adhesive or glue, a rouge or eyebrow pencil lead, and a rubber eraser, and more particularly to an improvement of such a dispenser and thread means for incorporation in the dispenser.

2. Description of the Prior Art

Many dispensers of this type have been provided in prior art. For example, U.S. Pat. No. 5,549,404 to Kageyama et al. is illustrative of such prior art. The patent discloses a stick-shaped material drive container which includes an outer cylinder and a screw shaft unrotatably inserted in the outer cylinder but movably in an axial direction thereof. The conventional drive container is complex in construction, so that it takes a lot of labor to assemble the drive container.

SUMMARY OF THE INVENTION

The present invention has been made in view of the foregoing disadvantages of the prior art.

Accordingly, it is an object of the present invention to provide a dispenser for selectively extending and retracting a substantially stick-shaped object, which is simple in construction and can be easily assembled.

It is another object of the present invention to provide thread means which can be easily incorporated in the dispenser as set forth above.

In accordance with one aspect of the present invention, there is provided a dispenser for selectively extending and retracting a substantially stick-shaped object. The dispenser comprises a substantially cylindrical body, a sleeve member having a closed end and received in the cylindrical body, the cylindrical body and sleeve member being rotatable relative to each other, an axially movable member inserted in the sleeve member, the axially movable member including a substantially rod-like body and a receiver member for receiving and supporting a substantially stick-shaped object, the rod-like body having first and second ends and a first threaded portion formed around a periphery thereof, the receiver member mounted on the first end of the rod-like body, the rod-like body extending through the closed end of the sleeve member to project into the cylindrical body, thread means fixed in the cylindrical body and having a second threaded portion for engagement with the first threaded portion of the rod-like body, so that when one of the cylindrical body and the sleeve member is rotated relative to the other of the cylindrical body and the sleeve member, the movable member is axially moved, thereby selectively extending and retracting the stick-shaped object having been supported by the receiver member, according to a rotational direction of the cylindrical body or the sleeve member, and a cap member detachably mounted on the cylindrical body.

The rod-like body of the movable member may have a first substantially elliptical shape in cross-section. The sleeve member may have a through-hole of a second substantially elliptical shape formed in the closed end thereof. The rod-like body extends through the through-hole with the first elliptical shape thereof being in the same posture as the through-hole of the second elliptical shape is formed in the closed end of the sleeve member. The rod-like body has a first diameter extending along a common short-axis of the first and second elliptical shapes and a second diameter extending along a common long-axis of the first and second elliptical shapes. The through-hole has a third diameter extending along the short-axis and a fourth diameter extending along the long-axis. The second diameter of the rod-like body is larger than the third diameter of the through-hole.

The dispenser may further include first cooperating means on the cylindrical body and the sleeve member for preventing the sleeve member from being detached from the cylindrical body.

The first cooperating means comprises a circumferential recess portion formed in a first inner peripheral area of the cylindrical body, and a circumferential projection provided around an outer peripheral area of the sleeve member. The circumferential projection of the sleeve member is engaged with the circumferential recess of the cylindrical body, whereby the sleeve member is prevented from being detached from the cylindrical body.

The dispenser may further include second cooperating means on the cylindrical body and the thread means for preventing the thread means from rotating relative to the cylindrical body.

The second cooperating means comprises first projection means provided on a second inner peripheral area of the cylindrical body and second projection means provided on an outer periphery of the thread means. The first projection means and the second projection means are engaged with each other, to thereby cause the thread means to be prevented from rotating relative to the cylindrical body.

The first projection means comprises a substantially serrated portion provided on the inner peripheral area of the cylindrical body and having sharp valleys. The second projection means comprises a plurality of axially extending projections provided around the outer periphery of the thread means and having pointed ends.

The dispenser may further include means on the rod-like body for preventing the movable member from being detached from the sleeve member.

According to a further aspect of the present invention, there is provided thread means for incorporation in a dispenser for selectively extending and retracting a substantially stick-shaped object. The dispenser includes a substantially cylindrical body, a sleeve member having a closed end and received in the cylindrical body, the cylindrical body and the sleeve member being rotatable relative to each other, and an axially movable member inserted in the sleeve member and having a substantially rod-like body and a receiver member mounted on an end of the rod-like body for receiving and supporting a substantially stick-shaped object, the rod-like body extending through the closed end of the sleeve member and having a first threaded portion provided around a periphery thereof, the axially movable member being adapted to be axially moved by causing one of the sleeve member and the cylindrical body to be rotated relative to the other of the sleeve member and the cylindrical body, thereby selectively extending and retracting the stick-shaped object according to a rotational direction of the cylindrical body or the sleeve member. The thread means comprises a substantially tubular body, the tubular body having a bore and a second threaded portion formed in a peripheral surface of the bore for engagement with the first threaded portion of the rod-like body and an axially extending slit for facilitating insertion of the rod-like body into the bore.

The slit widens in an outer, radial direction from a center of the tubular body, thereby to facilitate guiding the rod-like body into the bore of the tubular body.

The tubular body may have first and second hollow sections circumferentially provided on an outer periphery thereof and spaced apart from each other around the outer periphery of the tubular body.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate the same parts throughout the Figures and wherein.

DETAILED DESCRIPTION OF THE PREFERRED EMBODIMENT

A dispenser for selectively extending and retracting a substantially stick-shaped object of cartridge-type according to the present invention will be discussed hereinafter with reference to the accompanying drawings.

Figure 1:
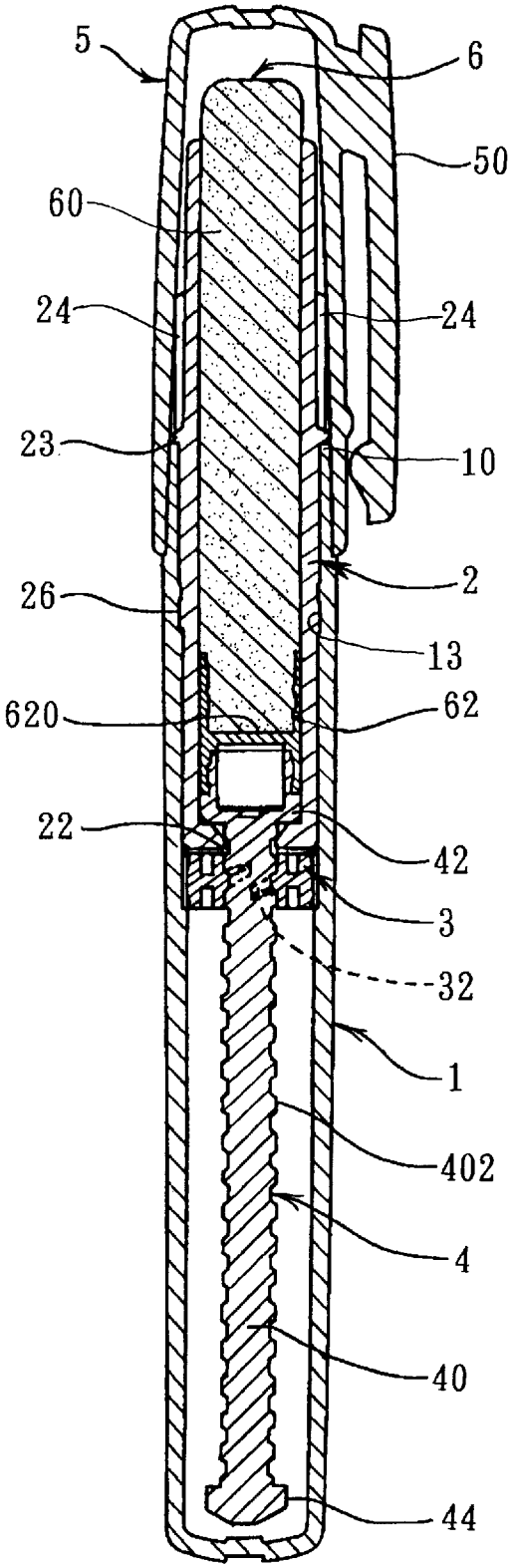
FIG. 1 is a schematic longitudinal sectional view of a dispenser according to the present invention.

Referring to FIG. 1, there is illustrated the dispenser. The dispenser generally includes a substantially cylindrical body 1, a sleeve member 2 received in the cylindrical body 1 and rotatable relative to the cylindrical body, a thread member 3 received and fixed in the cylindrical body 1, an axially movable member 4 extending through the sleeve member 2 and thread member 3, and a cap member 5 detachably mounted on the cylindrical body 1. A substantially stick-shaped object 6, e.g., a cartridge-type solid adhesive or glue member, is removably received in the sleeve member 2 and supported on the movable member 4. The cap member 5 is provided with a clip 50 for clipping the dispenser of the present invention to a shirt or jacket pocket or the like.

Figure 2:
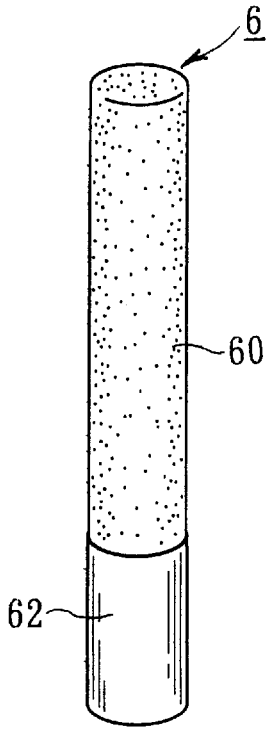
FIG. 2 is a schematic perspective view of a substantially stick-shaped object which is to be loaded into the dispenser of FIG. 1.

As shown in FIG. 2, the cartridge-type solid adhesive member 6 comprises a substantially stick-shaped solid adhesive material 60 and a holder member 62 holding the solid adhesive material 60. The holder member 62 comprises a substantially tubular body having a substantially H-shape in vertical section as shown in FIG. 1. The solid adhesive material 60 is supported at an end portion thereof on the holder member 62 by inserting the end portion of the solid adhesive material 60 in the tubular body of the holder member 62 and causing the end portion of the solid adhesive material 60 to be supported on a horizontal portion 620 of the holder member 62 as shown in FIG. 1.

Figure 3:
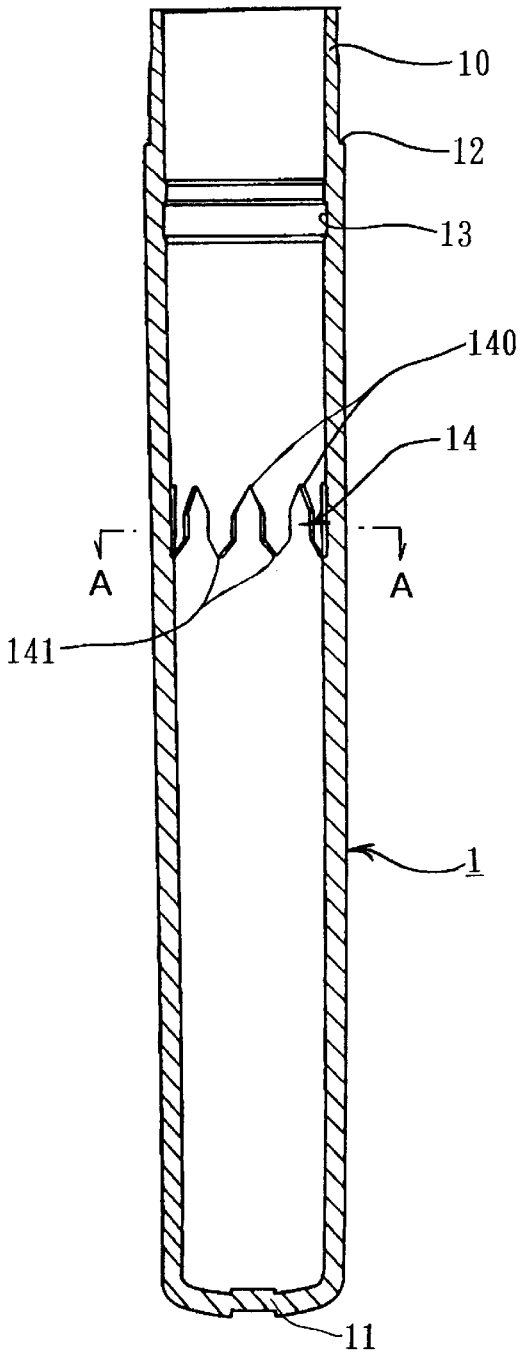
FIG. 3 is a schematic longitudinal sectional view of a cylindrical body of the dispenser.
Figure 4:
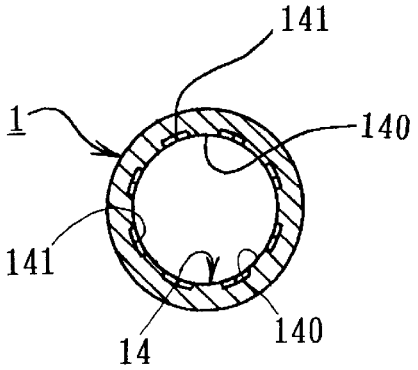
FIG. 4 is a schematic cross-sectional view of the cylindrical body, taken on a plane indicated at FIG. 3 by a line A—A.

Referring to FIGS. 3 and 4, there is illustrated the cylindrical body 1. The cylindrical body 1 has an opened end 10, a closed end 11, and an outer circumferential step portion 12 adjacent the opened end 10.

Figure 5:
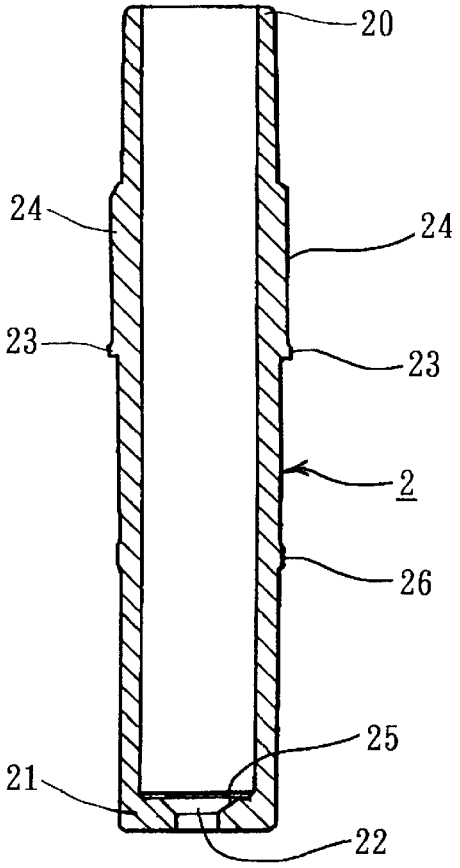
FIG. 5 is a schematic longitudinal sectional view of a sleeve member of the dispenser.
Figure 6:
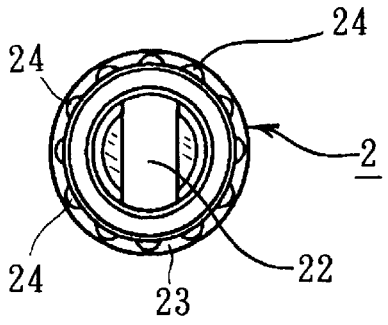
FIG. 6 is a schematic plan view of the sleeve member.

Referring to FIGS. 5 and 6, there is illustrated the sleeve member 2. The sleeve member 2 has an opened end 20, a closed end 21, a through-hole 22 of a substantially elliptical shape formed in the closed end 21, and an outer circumferential projection 23. As shown in FIG. 1, the sleeve member 2 is received in the cylindrical body 1 through the opened end 10 of the cylindrical body 1 with the outer circumferential projection 23 being abutted against an edge of the opened end 10 of the cylindrical body 1. The sleeve member 2 further includes a plurality of axially extending line-like projections 24 spaced apart from one another around an outer peripheral area of the sleeve member 2 which is adjacent the outer circumferential projection 23. The line-like projections 24 of the sleeve member 2 serve as non-slip means when the cylindrical body 1 and the sleeve member 2 are pinched with fingers of one hand of a user and fingers of the other hand of the user, respectively, and the sleeve member 2 is rotated relative to the cylindrical body 1 with the fingers or the cylindrical body 1 is rotated relative to the sleeve member 2 with the finger. As shown in FIG. 1, the movable member 4 is inserted in the sleeve member 2 through the opened end 20 of the sleeve member 2 and a rod-like body 40 of the movable member 4 extends through the through-hole 22 of the sleeve member 2. In order to facilitate insertion of the rod-like body 40 through the through-hole 22 of the sleeve member 2 upon assembling of the dispenser, a peripheral edge area 25 of the through-hole 22 of the sleeve member 2 which faces the interior of the sleeve member 2 is chamferred.

The dispenser further includes first cooperating means for preventing the sleeve member 2 from being detached from the cylindrical body 1. The first cooperating means comprises a circumferential recess portion 13 formed in an inner peripheral area of the cylindrical body 1 which is adjacent the opened end 10 of the cylindrical body 1 (see FIG. 3), and a circumferential projection 26 provided around an outer peripheral area of the sleeve member 2 (see FIG. 5). As shown in FIG. 1, the sleeve member 2 is received in the cylindrical body 1 with the circumferential projection 26 being engaged with the circumferential recess portion 13 of the cylindrical body 1, whereby the sleeve member 2 is prevented from being detached from the cylindrical body 1.

Figure 8:
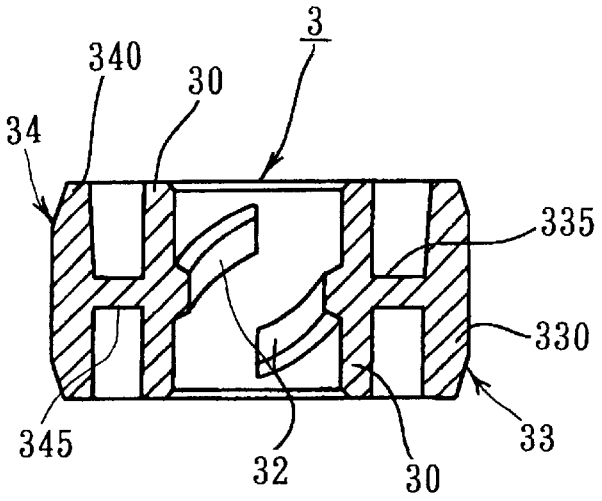
FIG. 8 is a schematic enlarged sectional view of the thread means, taken on a plane indicated at FIG. 7 by a line B—B.
Figure 7:
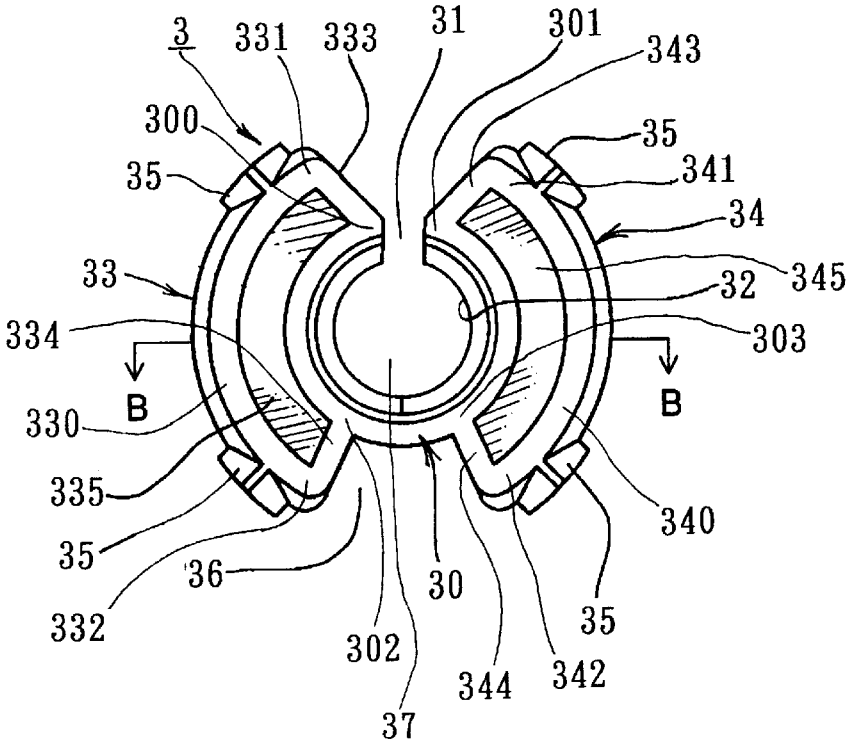
FIG. 7 is a schematic enlarged plan view of thread scans incorporated in the dispenser.
Figure 9:
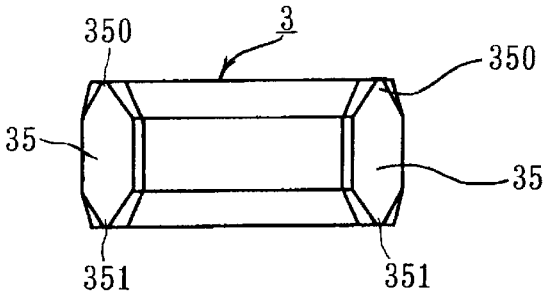
FIG. 9 is a schematic enlarged front view of the thread means.

Referring to FIGS. 7 to 9, there is illustrated the thread member 3. The thread member 3 is preferably made of any suitable flexible resinous material, e.g., polypropylene and polyethylene. The thread member 3 comprises a short tubular body 30 of a substantially C-shape in cross-section having a bore 37, an axially extending slit 31, first and second ends 300, 301 adjacent the slit 31 of the tubular body 30, and a first threaded portion 32 formed in an inner peripheral surface of the tubular body 30 which surrounds the bore 37, a first circular arc-shaped hollow section 33 provided on an outer peripheral surface of the tubular body 30 and circumferentially extending from the first end 300 of the tubular body 30 to a first predetermined region 302 of the tubular body 30, and a second circular arc-shaped hollow section 34 provided on the outer peripheral surface of the tubular body 30 and circumferentially extending from the second end 301 of the tubular body 30 to a second predetermined region 303 of the tubular body 30.

The first circular arc-shaped hollow section 33 comprises a first outer wall 330 of a substantially circular arc-shape having a first end 331 and a second end 332, a first radially extending wall 333 interconnecting the first end 331 of the outer wall 330 and the first end 300 of the tubular body 30, and a second radially extending wall 334 interconnecting the second end 332 of the first outer wall 330 and the first predetermined region 302 of the tubular body 30. A first webbing 335 is disposed in a first hollow portion surrounded by the first outer wall 330, the first and second radially extending walls 333, 334, and a first part of a circumferential wall of the tubular body 30. The first webbing 335 spreads perpendicularly to the first outer wall 330, the first and second radially extending walls 333, 334, and the first part of the circumferential wall of the tubular body 30. Like the first circular arc-shaped hollow section 33, the second circular arc-shaped hollow section 34 comprises a second outer wall 340 of a substantially circular arc-shape having a third end 341 and fourth end 342, a third radially extending wall 343 interconnecting the third end 341 of the second outer wall 340 and the second end 301 of the tubular body 30, and a fourth radially extending wall 344 interconnecting the fourth end 342 of the second outer wall 340 and the second predetermined region 303 of the tubular body 30. Further, a second webbing 345 is disposed in a second hollow portion surrounded by the second outer wall 340, the third and fourth radially extending walls 343, 344, and a second part of the circumferential wall of the tubular body 30. The second webbing 345 spreads perpendicularly to the second outer wall 340, the third and fourth radially extending walls 343, 344, and the second part of the circumferential wall of the tubular body 30. The first and second predetermined regions 302, 303 of the tubular body 30 are spaced apart from each other around the tubular body 30. A recess portion 36 is provided between the first circular arc-shaped hollow section 33 and the second circular arc-shaped hollow section 34. The first radially extending wall 333 and the third radially extending wall 343 have surfaces which slope in a manner to allow a radially widening space to be provided between the first radially extending wall 333 and the third radially extending wall 343. Therefore, when the rod-like body 40 of the movable member 4 is to be received in the bore 37 of the thread member 3 through the slit 31 of the thread member 3 in order that the thread member 3 is mounted on the rod-like body 40 as will be discussed in greater detail hereinafter, the rod-like body 40 can be received into the bore 37 of the thread member 3 while being guided by the sloping surfaces of the first and third radially extending walls 333, 343.

As described above, the thread member 3 is fixed in the cylindrical body 1. More particularly, the dispenser according to the present invention further includes second cooperating means on the cylindrical body 1 and thread member 3 for preventing the thread member 3 from rotating relative to the cylindrical body 1. The second cooperating means for preventing the thread member 3 from rotating relative to the cylindrical body 1 comprises first engaging projections 35 provided on the thread member 3 (see FIGS. 7 and 9), and a second engaging projection 14 provided on the inner circumferential surface of the cylindrical body 1 (see FIG. 3). More particularly, as shown in FIGS. 7 and 9, the first engaging projections 35 are formed on an outer surface of the first end 331 of the first outer wall 330, an outer surface of the second end 332 of the first outer wall 330, an outer surface of the third end 341 of the second outer wall 340, and an outer surface of the fourth end 342 of the second outer wall 340. As shown in FIG. 9, each of the first engaging projections 35 vertically extends at a corresponding one of the first, second, third and fourth ends 331, 332, 341, 342, and has an upper sharp end 350 and a lower sharp end 351. As shown in FIG. 3, the second engaging projection 14 is provided on an inner circumferential area of the cylindrical body 1 to which the thread member 3 is to be fixed. The second engaging projection 14 comprises a substantially serrated portion provided around the inner circumferential area of the cylindrical body 1. The serrated portion of the second engaging projection 14 has a plurality of sharp crests 140 and a plurality of sharp valleys 141. The thread member 3 is fixed in the cylindrical body 1 with the lower sharp ends 351 of the first engaging projections 35 being received in and engaged with the valleys 141 of the second engaging projections 14, whereby the thread member 3 is prevented from rotating relative to the cylindrical body 1. When a worker mounts the thread member 3 on the rod-like body 40 of the movable member 4 for assembly of the dispenser of the present invention as will be described hereinafter, the worker may accidentally mount the thread member 3 upside down on the rod-like body 40 of the movable member 4. In the illustrated embodiment, both the upper end 350 of each of the first engaging projections 35 and the lower end 351 of each of the first engaging projections 35 are pointed or sharp in order to comply with such trouble. Therefore, unless the trouble is considered, only the lower end 351 off each of the first engaging projections 35 may be pointed. Further, in order to facilitate causing the lower ends 35 of the first engaging projections 35 to be guided and received in the valleys 141 of the second engaging projection 14, the crests 140 of the second engaging projections 14 are pointed as described above.

Figure 10:
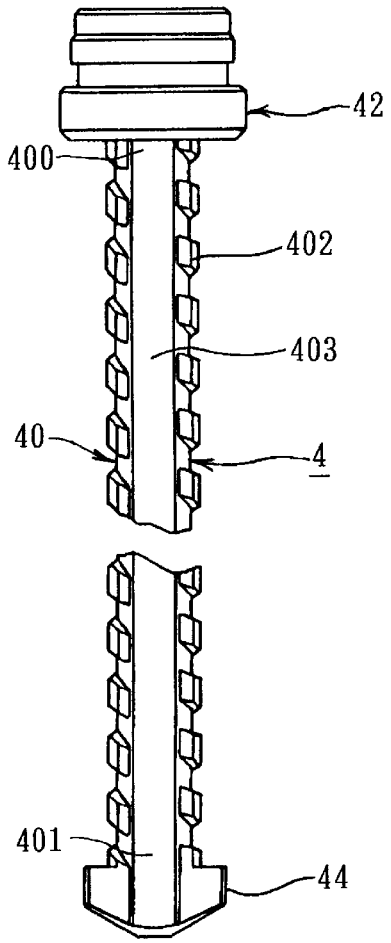
FIG. 10 is a schematic enlarged front view of a movable member of the dispenser.
Figure 11:
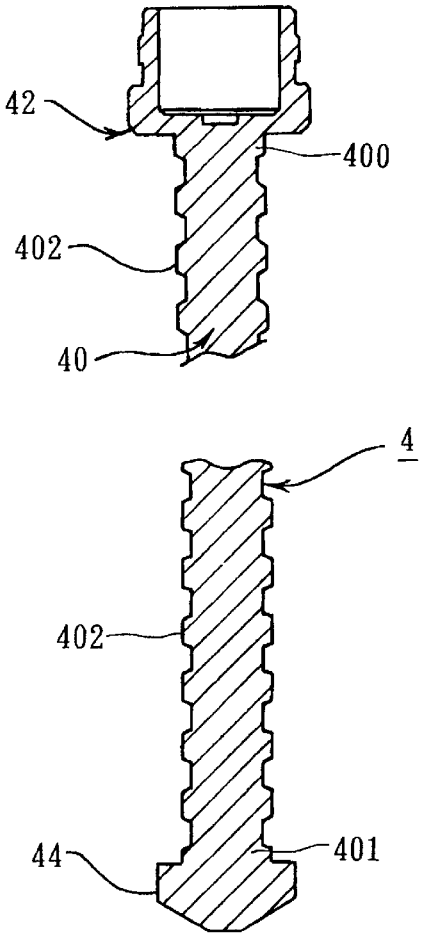
FIG. 11 is a schematic enlarged longitudinal sectional view of the movable member.
Figure 12:
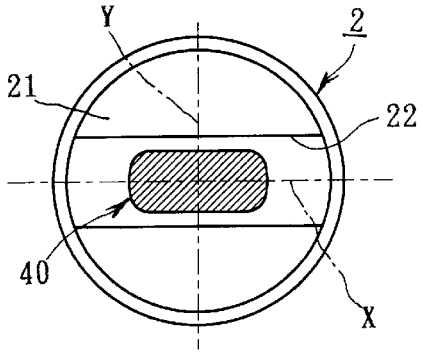
FIG. 12 is a schematic enlarged bottom view of the sleeve member through which the movable member extends.

Referring to FIGS. 10 to 12, there is illustrated the movable member 4. The movable member 4 comprises the rod-like body 40, of substantially elliptical shape in cross-section, having a first end 400 and a second end 401, a large diameter receiver member 42, of substantially U-shape in vertical-section, provided at the first end 400 of the rod-like body 40 for receiving and supporting the solid adhesive member 6, and a substantially arrowhead-shaped portion 44 provided at the second end 401 of the rod-like body for preventing the movable member 4 from being detached from the sleeve member 2. The rod-like body 40 has a threaded portion 402 provided over the total length of the rod-like body 40. As shown in FIG. 10, the threaded portion 402 is discontinued at several portions thereof by two flat surfaces 403 (only one flat surface 403 is shown in FIG. 10) which axially extend along the total length of the rod-like body 40. The arrowhead-shaped portion 44 of the movable member 4 has a size slightly smaller than that of the through-hole 22 of the sleeve member 2. When the dispenser of the present invention is assembled, the rod-like body 40 of the movable member 4 is received in the sleeve member 2 and inserted through the through-hole 22 of the sleeve member 2, and the large diameter receiver member 42 is supported on the closed end 21 of the sleeve member 2. The rod-like body 40 of the movable member 4 extends through the through-hole 22 with the elliptical shape of the rod-like body 40 being in the same posture as the through-hole 22 of the elliptical shape is formed in the closed end 21 of the sleeve member 2. As shown in FIG. 12, the rod-like body 40 has a first diameter extending along a common short-axis Y of the elliptical shapes of the rod-like body 40 and a through-hole 22, and a second diameter extending along a common long-axis X of the elliptical shapes of the rod-like body 40 and through-hole 22. The through-hole has a third diameter extending along the short-axis Y and a fourth diameter extending along the long-axis X. The second diameter of the rod-like body 40 which extends along the long-axis X is larger than the third diameter of the through-hole 22 which extends along the short-axis Y. Therefore, the rod-like body 40 is incapable of rotating relative to the sleeve member 2. The solid adhesive member is supported on the receiver member 42 of the movable member 4 by causing the holder member 62 of the solid adhesive member 6 to be mounted on the receiver member 42. In order to facilitate mounting of the holder member 62 on the receiver member 42, the receiver member 42 may be formed with a plurality of axially extending slits (not shown) which are circumferentially spaced apart from one another. In this case, the mounting of the holder member 62 on the receiver member 62 can be easily performed by causing a diameter of the receiver member 42 to be reduced while causing the receiver member 62 to be deformed radially.

In order to facilitate understanding of the present invention, a sequence of assembling of the dispenser according to the present invention will be discussed hereinafter with reference to the accompanying drawings.

The rod-like body 40 of the movable member 4 is first inserted into the sleeve member 2 and then inserted at the arrowhead-shaped portion 44 thereof through the through-hole 22 of the sleeve member 2. In a situation in which the receiver member 42 of the movable member 4 is supported on the closed end 21 of the sleeve member 2 and the rod-like body 40 of the movable member 4 is projected outwardly through the through-hole 22 of the sleeve member 2, the thread member 3 is mounted on the rod-like body 40 of the movable member 4 by causing the rod-like body 40 and the thread member 3 to be pressed against each other to fit the rod-like body 40 into the bore 37 of the thread member 3 through the slit 31. Thus, the mounting of the thread member 3 on the rod-like body 40 can be easily and speedily carried out. The thread member 3 is mounted on a portion of the rod-like body 40 in close proximity to an outer surface of the closed end 21 of the sleeve member 2, whereby the closed end 21 of the sleeve member 2 is securely sandwiched between the thread member 3 and the receiver member 42 of the movable member 4. After the mounting of the thread member 3 on the rod-like body 40 of the movable member 4 is completed, the first end 331 of the first circular arc-shaped hollow section 33 and the third end 341 of the second circular arc-shaped hollow section 34 are pinched with the worker's finger tips and pressed in such a direction as to come closer to each other. Thus, the thread member 3 is securely mounted on the rod-like body 40 of the movable member 4.

An assembly comprising the sleeve member 2, the thread member 3 and the movable member 4 is inserted into the cylindrical body 1 with the rod-like body 40 of the movable member 4 being received in the cylindrical body 1. Then, the outer circumferential projection 26 of the sleeve member 2 is brought into engagement with the inner circumferential recess portion 13 of the cylindrical body 1, whereby the assembly is prevented from being detached from the cylindrical body 1. Simultaneously, the lower sharp ends 351 of the first engaging projections 35 provided on the thread member 3 of the assembly are received in an engaged with the valleys 141 of the second engaging projection 14 provided on the inner circumferential surface of the cylindrical body 1, whereby the thread member 3 is prevented from being rotated relative to the cylindrical body 1. Then, the cap member 5 is mounted on the cylindrical body 1.

When the stick-shaped solid adhesive member 6 is to be loaded into the dispenser of the present invention assembled as discussed above, the cap member 5 is removed from the cylindrical body 1. The user pinches the sleeve member 2 with the fingers of one hand and pinches the cylindrical body 1 with the fingers of the other hand, and causes the sleeve member 2 to be rotated relative to the cylindrical body 1 or causes the cylindrical body 1 to be rotated relative to the sleeve member 2.

If the sleeve member 2 is rotated in a first direction relative to the cylindrical body 1 which has been pinched by the user's fingers, the rotation of the sleeve member 2 is provided to the movable member 4, to thereby cause the movable member 4 to be rotated while being engaged through the threaded portion 402 with the threaded portion 32 of the thread member 3 fixed in the cylindrical body 1. As the movable member 4 is rotated in the first direction together with the sleeve member 2, the movable member 4 is moved toward the opened end 20 of the sleeve member 2 while being engaged through the threaded portion 402 with the threaded portion 32 of the thread member 3 fixed in the cylindrical body 1. By further rotation of the sleeve member 2 relative to the cylindrical body 1, the receiver member 42 of the movable member 4 is operatively projected out of the opened end 20 of the sleeve member 2. In a state where the receiver member 42 is projected out of the opened end 20 of the sleeve member 2, the solid adhesive member 6 is supported on the receiver member 42 by causing the holder member 62 of the solid adhesive member 6 to be mounted on the receiver member 42. Then, the adhesive member 6 is retracted into the sleeve member 2 by causing the sleeve member 2 to be rotated relative to the cylindrical body 1 in a second direction that is reverse to the first direction.

If the cylindrical body 1 is rotated in the second direction relative to the sleeve member 2 which has been pinched by the user's fingers, the thread member 3 is simultaneously rotated in the same direction relative to the movable member 4 while being engaged through the threaded portion 32 with the threaded portion 402 of the movable member 4, since the thread member 3 is fixed in the cylindrical body 1. At this time, no torque is transmitted to the movable member 4, since the rod-like body 40 penetrating the through-hole 22 of the sleeve member 2 is incapable of rotating relative to the sleeve member 2 having been pinched by the user's fingers, as described above. As the thread member 3 is rotated relative to the movable member 4, the movable member 4 is moved toward the opened end 20 of the sleeve member 2 in response to the rotation of the thread member 3, whereby the receiver member 42 of the movable member 4 is operatively projected out of the opened end 20 of the sleeve member 2. In the state where the receiver member 42 of the movable member 4 is projected out of the opened end 20 of the sleeve member 2, the solid adhesive member 6 is supported on the receiver member 42 in the same manner as described above. Then, the adhesive member 6 is retracted into the sleeve member 2 by causing the cylindrical body 1 to be rotated in the first direction relative to the sleeve member 2. After the adhesive member 6 is retracted into the sleeve member 2, the cap member 5 is mounted on the cylindrical body to cover the opened end 20 of the sleeve member 2, whereby the adhesive material 60 of the adhesive member 6 can be prevented from drying up.

When the adhesive material 60 is to be applied onto, for example, a paper, the adhesive material 60 is operatively projected out of the opened end 20 of the sleeve member 2 by performing the same operation as is done for the actively projecting of the receiver member 42 out of the opened end 20 of the sleeve member 2.

The terms and expressions which have been employed are used as terms of description and not of limitation, and there is no intention in the use of such terms and expressions of excluding any equivalents of the features shown and described, or portions thereof, but it is recognized that various modifications are possible within the scope of the invention claimed.

What is claimed is:

1. A thread member for incorporation in a dispenser for selectively extending and retracting a substantially stick-shaped object, said dispenser including a substantially cylindrical body, a sleeve member received in said cylindrical body, said sleeve member having a closed end, said cylindrical body and said sleeve member being rotatable relative to each other, and a movable member inserted in said sleeve member and having a substantially rod-like body and a receiver member mounted on an end of said rod-like body for receiving and supporting a substantially stick-shaped object, said rod-like body extending through said closed end of said sleeve member and having a first threaded portion formed around a periphery of said rod-like body, said movable member being adapted to be axially moved by causing one of said sleeve member and said cylindrical body to be rotated relative to the other of said sleeve member and said cylindrical body, thereby selectively extending and retracting said stick-shaped object according to a rotational direction of said cylindrical body or said sleeve member, said thread member comprising:

a substantially tubular body adapted to be non-rotatably fixed in said cylindrical body, said tubular body having a bore, a second threaded portion formed in an inner peripheral surface surrounding said bore for engagement with said first threaded portion of said rod-like body, and an axially extending slit for facilitating insertion of said rod-like body into said bore upon assembly of said dispenser.

2. A thread member as defined in claim 1, wherein said tubular body has first and second hollow sections circumferentially provided on an outer periphery of said tubular body and spaced apart from each other around the outer periphery of said tubular body.

3. The thread member, as claimed in claim 1, wherein said slit widens in an outer, radial direction from a center of said tubular body.

4. The thread member, as claimed in claim 3, wherein said tubular body includes a first arc-shaped hollow section on an outer periphery, said first arc-shaped hollow section having a first end forming a boundary of said slit, wherein said tubular body includes a second arc-shaped hollow section on an outer periphery, said second arc-shaped hollow section having a second end forming a boundary of said slit, and wherein said first end and said second end are pressed in such a direction to come closer to one another subsequent to said guiding of said rod-like body of said movable member into said bore.

5. The thread member, as claimed in claim 1, wherein said dispenser includes a first cooperating member on said cylindrical body and said sleeve member for preventing said sleeve member from being detached from said cylindrical body.

6. The thread member, as claimed in claim 5, wherein said first cooperating member comprises a circumferential recess portion formed in an inner peripheral area of said cylindrical body, and a circumferential projection provided around an outer peripheral area of said sleeve member.

7. The thread member, as claimed in claim 1, wherein said dispenser includes a second cooperating member on said cylindrical body and said thread member for preventing said thread member from rotating relative to said cylindrical body.

8. The thread member, as claimed in claim 7, wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

9. The thread member, as claimed in claim 1, wherein said dispenser includes a first cooperating member on said cylindrical body and said sleeve member for preventing said sleeve member from being detached from said cylindrical body, and a second cooperating member on said cylindrical body and said thread member for preventing said thread member from rotating relative to said cylindrical body.

10. The thread member, as claimed in claim 9, wherein said first cooperating member comprises a circumferential recess portion formed in an inner peripheral area of said cylindrical body, and a circumferential projection provided around an outer peripheral area of said sleeve member, and wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

11. A thread member for incorporation in a dispenser for selectively extending and retracting a substantially stick-shaped object, said dispenser including a substantially cylindrical body, a sleeve member received in said cylindrical body, said sleeve member having a closed end, said cylindrical body and said sleeve member being rotatable relative to each other, and a movable member inserted in said sleeve member and having a substantially rod-like body and a receiver member mounted on an end of said rod-like body for receiving and supporting a substantially stick-shaped object, said rod-like body extending through said closed end of said sleeve member and having a first threaded portion formed around a periphery of said rod-like body, said movable member being adapted to be axially moved by causing one of said sleeve member and said cylindrical body to be rotated relative to the other of said sleeve member and said cylindrical body, thereby selectively extending and retracting said stick-shaped object according to a rotational direction of said cylindrical body or said sleeve member, said thread member comprising:

a substantially tubular body, said tubular body having a bore, a second threaded portion formed in an inner peripheral surface surrounding said bore for engagement with said first threaded portion of said rod-like body, and an axially extending slit for facilitating insertion of said rod-like body into said bore upon assembly of said dispenser, wherein said slit widens in an outer, radial direction from a center of said tubular body, thereby facilitating guiding of said rod-like body of said movable member into said bore upon assembly of said dispenser.

12. A thread member as defined in claim 11, wherein said tubular body has first and second hollow sections circumferentially provided on an outer periphery of said tubular body and spaced apart from each other around the outer periphery of said tubular body.

13. The thread member, as claimed in claim 11, wherein said dispenser includes a first cooperating member on said cylindrical body and said sleeve member for preventing said sleeve member from being detached from said cylindrical body.

14. The thread member, as claimed in claim 13, wherein said first cooperating member comprises a circumferential recess portion formed in an inner peripheral area of said cylindrical body, and a circumferential projection provided around an outer peripheral area of said sleeve member.

15. The thread member, as claimed in claim 11, wherein said dispenser includes a second cooperating member on said cylindrical body and said thread member for preventing said thread member from rotating relative to said cylindrical body.

16. The thread member, as claimed in claim 15, wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

17. The thread member, as claimed in claim 11, wherein said dispenser includes a first cooperating member on said cylindrical body and said sleeve member for preventing said sleeve member from being detached from said cylindrical body, and a second cooperating member on said cylindrical body and said thread member for preventing said thread member from rotating relative to said cylindrical body.

18. The thread member, as claimed in claim 17, wherein said first cooperating member comprises a circumferential recess portion formed in an inner peripheral area of said cylindrical body, and a circumferential projection provided around an outer peripheral area of said sleeve member, and wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

19. A dispenser for selectively extending and retracting a substantially stick-shaped object, comprising:

a substantially cylindrical body;

a sleeve member received in said cylindrical body and having a closed end, said cylindrical body and said sleeve member being rotatable relative to each other;

an axially movable member inserted in said sleeve member, said movable member including a substantially rod-like body having first and second ends, and a receiver member mounted on said first end of said rod-like body, said rod-like body having a first threaded portion formed around a periphery thereof, said rod-like body extending through said closed end of said sleeve member to project into said cylindrical body; and a thread member non-rotatably fixed in said cylindrical body having a substantially tubular body, a bore, and a second threaded portion surrounding said bore for engagement with said first threaded portion of said rod-like body, wherein said bore comprises an axially extending slit for facilitating insertion of said rod-like body into said bore upon assembly of said dispenser, and wherein said second threaded portion of said thread member is engaged with said first threaded portion of said movable member, so that when one of said cylindrical body and said sleeve member is rotated relative to the other of said cylindrical body and said sleeve member, the movable member is axially moved, thereby selectively extending and retracting said stick-shaped object having been supported by said receiver member, according to a rotational direction of said cylindrical body or said sleeve member.

20. The dispenser as defined in claim 19, further comprising a first cooperating member on said cylindrical body and said sleeve member for preventing said sleeve member from being detached from said cylindrical body.

21. The dispenser as defined in claim 20, wherein said first cooperating member comprises a circumferential recess portion formed in an inner peripheral area of said cylindrical body, and a circumferential projection provided around an outer peripheral area of said sleeve member.

22. The dispenser as defined in claim 20, further comprising a second cooperating member on said cylindrical body and said thread member for preventing said thread member from rotating relative to said cylindrical body.

23. The dispenser as defined in claim 22, wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

24. The dispenser, as claimed in claim 22, wherein said first cooperating member comprises a substantially serrated portion, and said second cooperating member comprises a plurality of axially extending projections.

25. The dispenser as defined in claim 19, further including a member on said rod-like body for preventing said movable member from being detached from said sleeve member.

26. The dispenser as defined in claim 19, wherein said second threaded portion is formed in an inner peripheral surface surrounding said bore for engagement with said first threaded portion of said rod-like body.

27. The dispenser as defined in claim 19, wherein said tubular body has first and second hollow sections circumferentially provided on an outer periphery of said tubular body and spaced apart from each other around the outer periphery of said tubular body.

28. The dispenser, as claimed in claim 19, wherein said slit widens in an outer, radial direction from a center of said tubular body.

29. The dispenser, as claimed in claim 28, wherein said tubular body includes a first arc-shaped hollow section on an outer periphery, said first arc-shaped hollow section having a first end forming a boundary of said slit, wherein said tubular body includes a second arc-shaped hollow section on an outer periphery, said second arc-shaped hollow section having a second end forming a boundary of said slit, and wherein said first end and said second end are pressed in such a direction to come closer to one another subsequent to said guiding of said rod-like body of said movable member into said bore.

30. A dispenser for selectively extending and retracting a substantially stick-shaped object, comprising:

a substantially cylindrical body;

a sleeve member received in said cylindrical body and having a closed end, said cylindrical body and said sleeve member being rotatable relative to each other;

an axially movable member inserted in said sleeve member, said movable member including a substantially rod-like body having first and second ends, and a receiver member mounted on said first end of said rod-like body, said rod-like body having a first threaded portion formed around a periphery thereof, said rod-like body extending through said closed end of said sleeve member to project into said cylindrical body;

a thread member fixed in said cylindrical body, having a second threaded portion, said second threaded portion of said thread member being engaged with said first threaded portion of said movable member, so that when one of said cylindrical body and said sleeve member is rotated relative to the other of said cylindrical body and said sleeve member, the movable member is axially moved, thereby selectively extending and retracting said stick-shaped object having been supported by said receiver member, according to a rotational direction of said cylindrical body or said sleeve member; and a cooperating member on said cylindrical body and said thread member for preventing said thread member from rotating relative to said cylindrical body, wherein said cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body, and wherein said first projection member comprises a substantially serrated portion provided on said inner peripheral area of said cylindrical body and having sharp valleys, and said second projection member comprises a plraulity of axially extending projections provided on said outer periphery of said thread member and having pointed ends.

31. The dispenser, as claimed in claim 30, further including a cooperating member on said cylindrical body and said sleeve member for preventing said sleeve member from being detached from said cylindrical body.

32. The dispenser, as claimed in claim 31, wherein said cooperating member on said cylindrical body and said sleeve member for preventing said sleeve member from being detached from said cylindrical body comprises a circumferential recess portion formed in an inner peripheral area of said cylindrical body, and a circumferential projection provided around an outer peripheral are of said sleeve member.

33. A dispenser for selectively extending and retracting a substantially stick-shaped object, comprising:

a substantially cylindrical body;

a sleeve member received in said cylindrical body and having a closed end, said cylindrical body and said sleeve member being rotatable relative to each other;

an axially movable member inserted in said sleeve member, said movable member including a substantially rod-like body having first and second ends, and a receiver member mounted on said first end of said rod-like body, said rod-like body having a first threaded portion formed around a periphery thereof, said rod-like body extending through said closed end of said sleeve member to project into said cylindrical body; and a thread member fixed in said cylindrical body, having a second threaded portion, said second threaded portion of said thread member being engaged with said first threaded portion of said movable member, so that when one of said cylindrical body and said sleeve member is rotated relative to the other of said cylindrical body and said sleeve member, the movable member is axially moved, thereby selectively extending and retracting said stick-shaped object having been supported by said receiver member, according to a rotational direction of said cylindrical body or said sleeve member, wherein said threaded member comprises a substantially tubular body, said tubular body having a bore, said second threaded portion being formed in an inner peripheral surface surrounding said bore for engagement with said first threaded portion of said rod-like body, and an axially extending slit for facilitating insertion of said rod-like body into said bore upon assembly of said dispenser, and wherein said slit widens in an outer, radial direction from a center of said tubular body, thereby facilitating guiding of said rod like body of said movable member into said bore upon assembly of said dispenser.

34. The dispenser as defined in claim 33, wherein said tubular body has first and second hollow sections circumferentially provided on an outer periphery of said tubular body and spaced apart from each other around the outer periphery of said tubular body.

35. The dispenser, as claimed in claim 33, wherein said dispenser includes a first cooperating member on said cylindrical body and said sleeve member for preventing said sleeve member from being detached from said cylindrical body.

36. The dispenser, as claimed in claim 35, wherein said first cooperating member comprises a circumferential recess portion formed in an inner peripheral area of said cylindrical body, and a circumferential projection provided around an outer peripheral area of said sleeve member.

37. The dispenser, as claimed in claim 33, wherein said dispenser includes a second cooperating member on said cylindrical body and said thread member for preventing said thread member from rotating relative to said cylindrical body.

38. The dispenser, as claimed in claim 37, wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

39. The dispenser, as claimed in claim 33, wherein said dispenser includes a first cooperating member on said cylindrical body and said sleeve member for preventing said sleeve member from being detached from said cylindrical body, and a second cooperating member on said cylindrical body and said thread member for preventing said thread member from rotating relative to said cylindrical body.

40. The dispenser, as claimed in claim 39, wherein said first cooperating member comprises a circumferential recess portion formed in an inner peripheral area of said cylindrical body, and a circumferential projection provided around an outer peripheral area of said sleeve member, and wherein said second cooperating member comprises a first projection member provided on an inner peripheral area of said cylindrical body, and a second projection member provided on an outer periphery of said thread member, said first projection member and said second projection member being engaged with each other, to thereby prevent said thread member from rotating relative to said cylindrical body.

* * * * *